US006338438B1

(12) United States Patent
Walzel et al.

(10) Patent No.: US 6,338,438 B1
(45) Date of Patent: Jan. 15, 2002

(54) PROCESS AND A DEVICE FOR ATOMIZING LIQUIDS

(75) Inventors: Peter Walzel, Dormagen (DE); Christian Reedtz Funder, Moldrup (DK); Soren Birk Flyger, Stenlose (DK); Poul Bach, Birkerod (DK)

(73) Assignee: Niro Holdings A/S, Soborg (DK)

( * ) Notice: Subject to any disclaimer, the term of this patent is extended or adjusted under 35 U.S.C. 154(b) by 0 days.

(21) Appl. No.: 09/598,999

(22) Filed: Jun. 22, 2000

Related U.S. Application Data

(62) Division of application No. 08/954,086, filed on Oct. 20, 1997, now Pat. No. 6,098,895, which is a continuation of application No. 08/525,564, filed on Nov. 14, 1995, now abandoned.

(30) Foreign Application Priority Data

Mar. 19, 1993 (DE) ..... 43 08 842

(51) Int. Cl.[7] ..... B05B 17/05; B05B 7/10; A62C 31/00

(52) U.S. Cl. ..... 239/7; 239/398; 239/406

(58) Field of Search ..... 239/7, 223, 224, 239/225, 398, 406

(56) References Cited

U.S. PATENT DOCUMENTS

| | | | | |
|---|---|---|---|---|
| 2,920,830 A | | 1/1960 | Nyrop et al. | 239/224 X |
| 3,197,143 A | | 7/1965 | Norris | 239/223 |
| 3,250,473 A | | 5/1966 | Hege | |
| 4,427,541 A | * | 1/1984 | Crosby et al. | 209/210 |
| 4,898,331 A | | 2/1990 | Hansen et al. | 239/223 |
| 5,219,076 A | * | 6/1993 | Crosby et al. | 209/210 |
| 5,272,820 A | * | 12/1993 | Ito et al. | 34/57 |
| 5,461,089 A | * | 10/1995 | Handyside et al. | 523/171 |
| 6,098,895 A | * | 8/2000 | Walzel et al. | 239/7 |

FOREIGN PATENT DOCUMENTS

| | | |
|---|---|---|
| FR | 2662374 | 11/1991 |

* cited by examiner

*Primary Examiner*—David A. Scherbel
*Assistant Examiner*—Davis Hwu
(74) *Attorney, Agent, or Firm*—Sughrue Mion, PLLC

(57) ABSTRACT

Liquid to be atomized is uniformly sprayed on the inner surface of a hollow rotating cylinder, for example by means of one- or two-fluid-nozzles and is thus distributed on apertures provided in the cylinder wall. The rotation of the cylinder causes the liquid to flow outwards through the apertures. Droplets are generated when the liquid flows out of the apertures by laminary decomposition of the jet. The flow rate in each aperture lies in the range $1.0<\dot{V}_A\ (a^3\rho^5/\sigma^5)^{0.25}<16$ to prevent the droplets from becoming too large and to satisfy the condition of an adequate flow laminarity, i.e. for the value of the Reynolds Number for the continuous liquid flow in the apertures not to exceed $Re_\delta$ 400. $\dot{V}_A$ represents the flow rate of the liquid in each aperture, a represents the centrifugal acceleration at the outer surface of the cylinder, ρ represents the density of the liquid, and 8 indicates the surface tension of the liquid. The large number N>200 of apertures having the diameter $D_A$ in the cylinder wall causes the flow rate of liquid through each aperture to be relatively low, so that a continuous laminary flow in each aperture is ensured even at low viscosities and technically useful total flow rates.

47 Claims, 8 Drawing Sheets

PROCESS AND A DEVICE FOR ATOMIZING LIQUIDS

This application is a divisional application of U.S. application Ser. No. 08/954,086, filed Oct. 20, 1997, now U.S. Pat. No. 6,098,895. Allowed on Feb. 9, 2000, which is a continuation of U.S. application Ser. No. 08/525,564, now abandoned.

BACKGROUND OF THE INVENTION

1. Field of the Invention

The present invention relates to a process for producing droplets with a narrow size distribution from liquids. The term liquid used in connection with the invention covers both clear liquids, such as solutions, and for instance metal melts and flowable dispersions, like for instance suspensions.

2. Description of the Prior Art

Producing droplets from liquids is often termed atomization. Common atomizing processes used commercially at a large scale are spraying under pressure in single-fluid pressure nozzles, for instance hollow cone nozzles, spraying with a gas in two-fluid nozzles or pneumatic atomization and the atomization with rotary atomizers. The invention relates to processes according to the last-mentioned principle.

In many technical processes a narrow droplet size distribution is desired. This is, inter alia, because spray drying plants must be dimensioned according to the biggest droplets of the spray, as these droplets require the longest residence time in the drier. Thus a broad droplet spectrum means, in spite of a lower average droplet size, large and consequently unfavorable dimensions. The smallest droplets in the spray necessitate high costs for cleaning the discharge air in form of filters and cyclones or like devices. A broad droplet size spectrum moreover leads to a broad particle size distribution of the produced spray-dried powder and, consequently, in some cases to undesirable technical properties.

Up until now all known atomization processes which are used technically at a large scale, i.e., a production capacity of more than 100 kg/h, produce droplets with comparatively broad size spectrums. See for instance Chem.-Ing. Techn. 62 (1990) 12, pp. 983–994.

Admittedly, droplets with a fairly narrow size distribution may be obtained with rotary atomizers of commonly used design. Thereby, the effect of the laminar jet disintegration is utilized. If the liquid is delivered to the center of a plane around a rotating disc, it flows—when a certain limited liquid production is kept—as a laminar film radially outwards and forms at the trailing edges of the disc threads of liquid. The liquid threads are created at the periphery of the trailing edge in a natural way with regular spacing. The subsequent disintegration of the liquid threads results in droplets with a very narrow size spectrum. If the size distribution of the droplets thus attained is described, for instance with the RRSB function according to DIN 66 141, then an evenness parameter of $6<m<8$ is attained. As average droplet size $d_{v,50}$ is in the present text the droplet diameter defined at which the 50%-value of the volume distribution is obtained; i.e. that 50% of the sprayed liquid volume includes smaller droplet diameters, and 50% of the sprayed liquid includes bigger droplet diameters than $d_{v50}$.

A considerable drawback of the atomizing method with plane rotating discs is that the amount of liquid passing this flow area is very small. As an estimate, the passing amount $\dot{V}$ of low-viscous liquids will lie in the range of $0.21<\dot{V}(\rho^3 n^2/D^3\sigma^3)^{0.25}<0.32$. D is the disc diameter, ρ the liquid density, σ the surface tension of the liquid, and n the speed of rotation. Both the narrow limits of the throughput range and the low value of the throughput of liquid hinder widespread use of this process.

In order to obtain a higher throughput it has been suggested to arrange several discs over each other, Chem.-Ing.-Techn. 36 (1964) 1, pages. 52–59. A uniform distribution of the liquid on the discs is however difficult to obtain with a device that does not easily clog. The narrow throughput range is also in this connection a drawback.

Recently, discs or cuts have been used, which at their periphery are provided with evenly spaced notches or grooves, for spraying of lacquers. In this way the throughput range can be broadened while maintaining laminar jet formation. However, also with this embodiment the throughput range is insufficient for many technical purposes.

FR A-2 662 374 discloses an atomizer rotor which is capable of working with varying volume, a homogenous atomization being obtained even with high-viscous liquids. This atomizer rotor is on the outside provided with grooves, to which the liquid to be atomized is supplied through perforations in the cylindrical wall of the rotor. It is stated that the length of these perforations must never exceed double their diameter. The liquid to be atomized is distributed on the inner side of the rotor by a stationary tube. It seems in particular to be grooves arranged on the exterior of the rotor that are to ensure an even droplet size at the atomization, and the advantage obtained is limited.

The atomizer normally used for spray drying consists of a low, cylindrical body, most frequently called atomizer wheel, said body having apertures or ducts. The diameter of the apertures are normally in the range of 5–30 mm. The liquid is often supplied centrally and flows radially outwards and leaves the atomizer through the apertures. The design has admittedly the advantage that the comparatively big apertures normally do not clog, but the throughput for large scale technical uses is chosen so high that the liquid leaves the apertures in thick turbulent jets. Due to the high relative speed between the liquid and the surrounding gas, the liquid jets which already leave the openings turbulently are dispersed. Thereby droplets are created at high rotational speed which is necessary in respect of small droplet dimensions, the droplets having a very broad size spectrum. At the same time a considerable wear of the walls of the apertures occurs when suspensions are atomized on account of the high flow speed.

SUMMARY OF INVENTION

The turbulence in the liquid jets is on account of the high relative speed between liquid and the gas surrounding the atomizer still further enhanced. It is known that a high jet turbulence always leads to droplets with a broad size spectrum. Usual evenness parameters of the RRSB distribution lie approximately in the range $2<m<4$. Typical liquid throughputs lie with the conventional process, for instance for an average droplet size of 250 μm at approximately 20–200 l/h per aperture. Typically a number n of revolutions per minute of 10,000–30,000 is used, which depending on the diameter results in centrifugal accelerations a in the range from 5.10 to $1.10^6$ m/s$^2$. Here the limit is set by the strength of the material of which the wheel is made.

According to the invention, these drawbacks are eliminated by adjusting the throughput of the liquid in the apertures in the wall of a rotating hollow cylindrical body (cylinder) to a comparatively small and equal value. At the same time on account of the throughput limit per aperture a plurality of apertures is necessitated, in order to obtain technically desired throughputs. The liquid flows laminarily at suitable low throughputs through the apertures, so that when leaving the aperture a laminar jet disintegration takes place. Provided that the throughput per aperture remains the same and sufficient aperture lengths are provided for, the diameter of the apertures may surprisingly be changed within broad limits without any perceptible effect on the droplet size. In this way, fine droplets with narrow size distribution may be obtained at comparatively low speed and with comparatively big apertures, with very little tendency to clog. Thereby the droplet size is determined to a high degree by the throughput and the number of apertures, to a small degree by the rotary speed of the atomizer, and to a very little degree by the liquid density and the surface tension. The small flow rate in the apertures further provides the advantage that no substantial wear occurs.

The minimum throughput per aperture is determined by the lower limit, which is necessary for the formation of a jet. For low-viscous liquids, the throughput per aperture amounts according to measurements to:

$$\dot{V}_A=1.0(\sigma^5/\alpha^3\rho^5)^{0.25}.$$

The maximum advisable throughput is determined on basis of the recognition that with increasing throughput of liquid in the present process the droplet size increases by approximately $(\dot{V}_A)^{0.33}$, and that the turbulence in the leaving liquid threads at a low viscosity results in a broadening of the droplet spectrum. As a practical value for the throughput the following value can be given $$\dot{V}_A=16(\sigma^5/\alpha^3\rho^5)^{0.25}$$

Furthermore, according to the present process the Reynolds Number in the apertures should not exceed the value $Re_\delta=400$ to ensure that the flow in the apertures remains laminar. This is a prerequisite for the desired narrow droplet spectrum. If the Reynolds number $Re_\delta=200$ is not exceeded, it is ensured that the flow remains laminar. The Reynolds Number can be calculated from the liquid throughput according to:

$$Re_\delta=\alpha\delta^3_{hy}\rho^2/3\eta^2$$

$\eta$ is in this connection the dynamic viscosity of the liquid. The hydraulic depth of the stream, which describes the flow condition in the apertures having the diameter $D_A$, results with good approximation, for the range characteristic for the process, from:

$$\delta_{hy}=1.06[\dot{V}_A\eta/(\alpha\rho\sqrt{D_a})]^{2/7}.$$

From these equations the conditions for a sufficient laminarity of the flow are obtained with a Reynolds Number $Re_\delta=400$, viz.

$$\dot{V}_A<3195(\eta^2/\alpha\rho^2)^{7/6}(\alpha\rho\sqrt{D_A}\eta).$$

The evenness parameter of the RRSB distribution lies under this condition in the range of $6<m<8$ which is characteristic for the laminar jet disintegration.

The invention relates to a process for atomizing a liquid comprising the steps of:

introduction of the liquid into a hollow, rotatable, cylinder having a cylinder wall with an inner surface and an outer surface and having a plurality of apertures formed between the inner and outer surfaces, and rotating the cylinder at a predetermined rotational speed, wherein the liquid is evenly distributed on the inner cylinder surface and over the apertures to provide, per aperture, a volumetric flow rate $\dot{V}_A$ within the range $$1.0<\dot{V}_A(a^3\cdot\rho^5/\sigma^5)^{0.25}<16,$$

where a represents the centrifugal acceleration of the cylinder at the outer surface, $\rho$ is the density of the liquid, $\sigma$ is the surface tension of the liquid, and $\eta$ is the dynamic viscosity of the liquid, the centrifugal acceleration being determined by $a=2\,D\,\pi^2n^2$, where D is the diameter of the outer surface, and n is the predetermined rotational speed, whereby a laminar disintegration of jets of the liquid leaving the plurality of apertures is produced.

If it is desired to operate using a Reynolds Number of the stream in the apertures, which does not exceed the value 200, the condition $$\dot{V}_A<1410(\eta^2/a\rho^2)^{7/6}(a\rho\sqrt{D_A}/\eta)$$

must be met.

In spray drying it may occur that product deposits form at the outlet of the apertures in the rotary atomizer. Such deposits can be avoided by introducing gas, preferably drying gas which is saturated with solvent vapor, or by introducing solvent vapor or water vapor in the cylinder. When atomizing melts the introduction of heated gas into the cylinder causes a pre-heating of the body and during operation the temperature is thereby maintained in order to avoid the formation of deposits. As will be demonstrated later, a deflection of the droplets in the axial direction can also be obtained by means of the gas in connection with a suitable orientation of the aperture axes.

The invention also relates to a process, which is characterized in that in addition to liquid, gas is also introduced into the cylinder.

Introduction of liquid into the cylinder may, for instance, take place via a small tube which is placed above a baffle plate rotating together with the cylinder. The baffle plate is preferably placed in the middle of the cylinder and fixed to the bottom thereof. The liquid, which leaves the small tube in form of a jet, is slung outwards by the baffle plate and consequently onto the interior cylinder surface and, thereby, distributed over the apertures.

The homogenous distribution of the liquid on the interior cylinder surface may take place in a particularly simple way by spraying with one-fluid-nozzles or with pneumatic spraying nozzles, also often called two-fluid-nozzles. One-fluid-nozzles, which produce a conical jet, have turned out to be particularly advantageous. Another advantageous way of distributing the liquid in the interior of the cylinder is to spray it onto the interior of the cylinder by concentrically arranged rotary nozzles, in particular nozzles providing a flat spray.

The invention relates to a process which is characterized in that the liquid is injected into the cylinder by means of a one-fluid nozzle, or a pneumatic atomizing nozzle, and is in this way evenly distributed on the inner cylinder surface and on the apertures. The invention also relates to a process which is characterized in that the liquid is injected into the cylinder through one or more rotating nozzles. Moreover, the invention relates to a process according to which the nozzle produces a hollow conical spray jet.

A preferred device for carrying out the process according to the invention includes a hollow cylinder, in the wall of which a plurality of apertures are provided. To enable throughputs sufficient for commercial use the number of apertures is at least 200.

The dimensions of the apertures in the cylinder wall should be chosen in such a way that on one hand a number as large as possible can be arranged in the cylinder surface, and on the other hand so that clogging of the apertures is avoided by sufficient dimensions. The spacing of the apertures should be as narrow as possible in order to allow the largest possible number of apertures in the cylinder jacket. Through a sufficient aperture length is ensured that all droplets from the spraying nozzles end in the apertures and unite in one liquid stream.

The apertures may have varying cross-sections, for instance rectangular or triangular, or may be larger apertures with various V-shaped flow grooves. Quadrangular apertures have the advantage that lower Reynolds Numbers are attained in the apertures with the same throughput and the same dimensions of the apertures. They are, however, more difficult to produce and lead to a reduced cylinder strength. In connection with rectangular and triangular apertures, as well as apertures having several V-shaped grooves, it is possible to determine an expression for the hydraulic depth of the flow and, thereby, to obtain a condition for a sufficient laminarity. Conditions may also be set up in order to avoid clogging and to obtain a sufficient number of channels.

When atomizing suspensions, it is preferable to use an apparatus in which the apertures are counterbored in the interior of the cylinder in such a way that no cylindrical surface remains in the interior. Through these measures, dispersed particles from the suspension are prevented from being deposited and caking on the cylinder surface.

Also, in connection with larger apertures with several V-shaped channels, it is possible by means of the width of the aperture to reduce the interior cylinder surface. With larger apertures having several V-shaped channels, the safety against clogging is increased. The same flow is obtained in a V-shaped channel as in the corner of a triangular aperture.

A particularly even distribution of the liquid flow at a low throughput per aperture, which is typical for the process, takes place in a device in which the aperture edges at each aperture are projecting inwardly to the same extent. Thereby a cylindrical liquid layer is created in the rotating cylinder. By supply of more liquid, the liquid flows regularly over the projecting aperture edges into the apertures.

In a simple way such a device can be produced by small tubes being inserted in the somewhat larger apertures in the cylinder wall, the tubes all projecting with the same distance over the interior cylinder wall. Another possibility of producing a device with inwardly projecting aperture edges arises from arranging grooves in the direction of the cylinder-generatrix as well as grooves in the peripheral direction between the apertures in the interior of the cylinder. This process is preferably suitable for apertures which are arranged with rectangular spacing.

In particular in respect of low-viscous liquids, or when the Reynolds Number $Re_\delta$ in apertures extending radially resumes a larger value than 400, it is an advantage if the apertures in the cylinder in the rotary plane are inclined in relation to the radial direction. In low-viscous liquids, the turbulence of the liquid threads leaving the aperture can be reduced so that the outwardly extending aperture axes at their point of intersection with the exterior cylinder surface keep an angle $\alpha<90°$ in relation to the vector of the peripheral speed (forwards inclination), whereby the rotation causes an accumulation of liquid to take place in the aperture. By this measure, the effective acceleration in the axial direction of the apertures is reduced. For instance at an angle inclination of $\alpha=27.5°$ the effective acceleration is halved in the axial direction of the apertures in comparison with $\alpha=90°$. Thereby the flow speed in the aperture is reduced and the depth $\delta_{hy}$ of the stream is increased. For high-viscous liquids, and in particular for suspensions, the angle $\alpha>90°$ should be chosen (backwards inclination) to avoid sedimentation of solid particles. Also, the higher viscosity provides a sufficient laminarity of the flow at $\alpha>90°$. The apertures may be straight but also curved.

The invention relates to a device which is characterized by apertures having such dimensions that the extension of the axes over the exterior cylinder surface all keep the same angle $\alpha$ in the range of 10°21 $\alpha<170°$ in relation to the vector of the peripheral speed, and to a device which is characterized in that the extension of the aperture axes over the exterior cylinder surface are inclined by the angle $\beta$ in the range of $0°<\beta<80°$ in relation to the plane of rotation.

Irregularities in distribution of the liquid on the interior cylinder wall, and on the apertures, can be avoided by a rotationally symmetrical distribution body which is concentrically mounted in the cylinder and the diameter of which increases towards the bottom of the cylinder. A particularly simple embodiment is a distribution body which is fastened in the cylinder. If the distribution body is independently rotatable from the cylinder, a favorable number of revolutions of the distribution body for distribution of liquid can be set at any chosen number of revolutions of the cylinder.

A particularly advantageous embodiment of a distribution body comprises a body which is provided with grooves on its upper surface, the grooves extending in the peripheral direction, whereby various circular discharge edges are created. Thereby portions of liquid are ejected at various levels in the direction of the interior cylinder surface. This causes an even distribution of liquid. An advantageous embodiment of a distribution body consists of circular plates which are connected by spacers. In this embodiment the diameter and distance of the circular plates can be changed in a simple way in dependence on the requirements to the distribution of the liquid supplied to the cylinder.

An object of the invention is to provide a device, for atomizing liquids, with a hollow rotating cylinder which comprises a rotationally symmetrical distribution body arranged concentrically in the cylinder, wherein the diameter of the distribution body increases towards the bottom, and a device which is characterized by a distribution body which is fixed to the cylinder.

Moreover, the invention relates to a device for atomizing liquids with a hollow rotating cylinder, which device is characterized by a distribution body which is rotatable independently of the cylinder.

Further, the invention relates to a device for atomizing liquids with a hollow rotating cylinder, which device is characterized in that the distribution body is provided with grooves running in the peripheral direction, and a device in which the distribution body consists of circular plates and spacers.

Likewise, the invention relates to a device for atomizing liquids with hollow cylinders, the device being characterized by apertures in the cylinder wall, the edges of which protrude into the interior of the cylinder and protrude with the same distance over the interior cylinder surface.

The same throughput per aperture in the cylinder can, in particular with respect of liquids which do not contain any solids, also be obtained by means of a cylindrical porous layer with uniform wall thickness. For instance filter layers or porous sinter bodies come into consideration.

Irregularities of the spray of the nozzles can, moreover, be equalized by baffles which are built into the cylinder. The baffles may rotate with the cylinder or may rotate with a different direction of rotation or a different number of revolutions from that of the cylinder. The baffles give a radial and axial distribution of liquid in the cylinder. Preferred embodiments of these baffles include concentrically perforated cylinders which rotate with the cylinder and which are fixed to the cylinder, helically wound perforated plates, or wire netting. The mesh width, i.e., the size of the apertures in the baffles, is to be larger than the diameter of the apertures in the cylinder.

The invention also relates to a device for atomizing liquids with rotating hollow cylinders, which includes a second cylindrical porous body which is concentrically mounted in the cylinder and the wall thickness of which is uniform, and a device which is characterized by baffles built into the cylinder.

An object of the invention is also to provide a device for atomizing liquids with rotating hollow cylinders, which device is characterized by baffles in the cylinder which are rotatable independently of the cylinder, and characterized by baffles in the form of concentrically arranged, cylindrical, perforated plates, and in the form of concentrically arranged wire netting, and by baffles in which the hole diameter, i.e. the mesh width, is larger than the dimensions of the apertures in the cylinder wall.

The invention also relates to a device for atomizing liquids with rotating hollow cylinders, the device having built in baffles in form of perforated plates and/or wire nettings, which are helically wound.

The device according to the invention for atomizing liquids and having rotating hollow cylinders is particularly suited for the manufacture of spray dried powder with an average droplet size of 50 $\mu$m to 400 $\mu$m from liquids, for the manufacture of powders from organic melts with grain or droplet size in the range of 0.5 mm–3 mm, and in particular for metal powder from melts with drain or droplet size in the range of 10 to 100 $\mu$m. The droplet sizes mentioned here are, however, solely typical values for the above-mentioned uses. It is, of course, possible with the device according to the invention to cover also a wider range of droplet sizes. A further area of use for the device according to the invention is in scrubbing plants for gas for removal of dust and washing out chemical substances.

An object of the invention is the use of a device for atomizing liquids, the device having rotating hollow cylinders, for spray drying, for the manufacture of powders from melts, and the use of the device for gas purification.

As material for the cylinder, metal, plastics, and ceramics, are preferably used.

BRIEF DESCRIPTION OF THE DRAWINGS

The invention will be described in detail with reference to the accompanying drawings in which.

DESCRIPTION OF THE PREFERRED EMBODIMENTS

Figure 1:
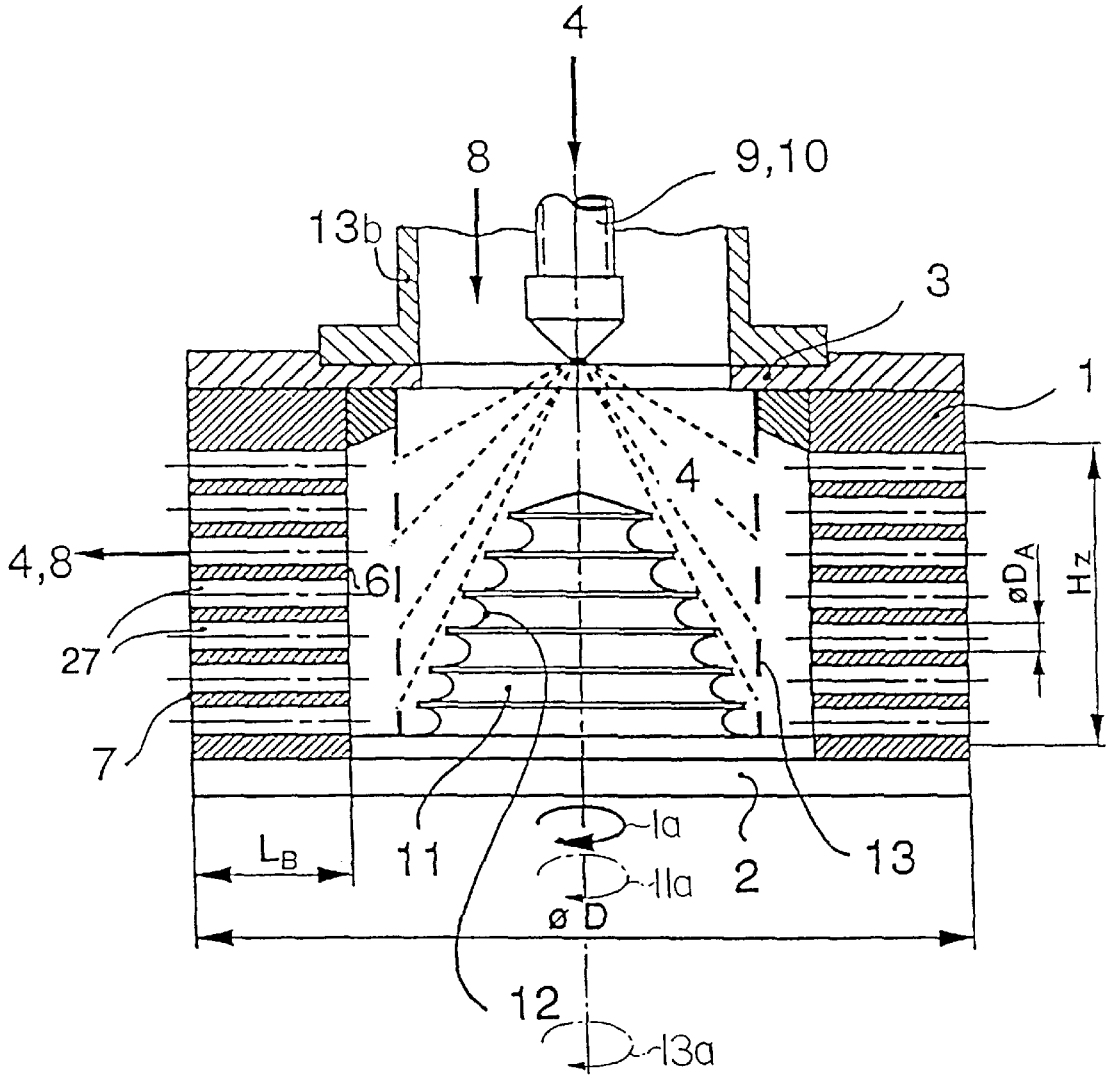
FIG. 1 is a side cut away view of a first embodiment of this invention.

FIG. 1 shows a typical embodiment of the invention. The liquid 4 is injected into a rotating hollow cylinder including a cylinder wall 1, a bottom 2 and a cover 3 with a central aperture. The liquid leaves the cylinder through apertures 27 in the cylinder wall 1. The rotation of the rotating hollow cylinder is indicated by the solid arrow 1*a*. The droplets are created at the outlet of the apertures 27 by laminar jet disintegration. The cylinder wall 1 is limited towards the interior by the interior cylinder surface 6 and towards the exterior by the exterior cylinder surface 7. The liquid 4 is evenly distributed on the inner cylinder surface 6 and, consequently, over the apertures 27. In addition to the liquid 4, also gas 8 flows into the cylinder. The gas leaves the cylinder together with the liquid 4 through the apertures 27.

The even distribution of the liquid 4 on the interior cylinder surface 6 may, for instance, be performed by a single-fluid nozzle 9—the nozzle used here produces a cone-shaped spray jet—or by two-fluid nozzles 10. The distribution of the liquid 4 in the cylinder is improved by means of a distribution body 11. In the embodiment shown, the distribution body 11 includes a body which is concentrical with the cylinder and the diameter of which increases towards the bottom 2. The distribution body 11 may be fixed with respect to the cylinder wall 1 or independently rotatable with respect thereto as indicated by the dashed arrow 11*a*. The distribution body 11 is provided at its upper surface with grooves 12 in the peripheral direction.

Baffles 13, in form of a cylindrical perforated plate, are provided in the interior of the cylinder to distribute the liquid regularly on the interior cylinder surface 6 and on the apertures 27. The baffles 13 may be fixed with respect to the rotating cylinder wall 1 or independently rotatable with respect thereto as indicated by a dot and dash arrow 13*a*. The cylinder wall 1 and, if applicable, the distribution body 11 and/or the baffles 13 is operated through the hollow shaft 13*b*.

Figure 2:
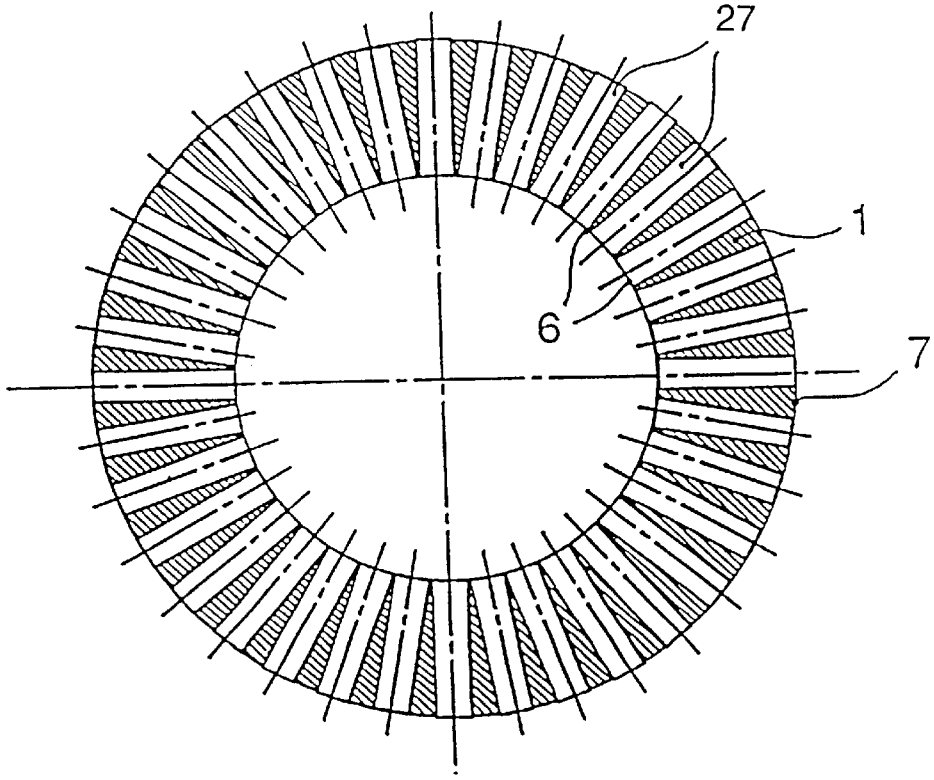
FIG. 2 is a cross-sectional view of the perforated cylinder in a rotational plane.

FIG. 2 is a cross-sectional view of the perforated cylinder in a rotational plane. On the drawing the cylinder wall 1, the exterior cylinder surface 7, the interior cylinder surface 6, and the apertures 27 in the cylinder wall 1 can be seen.

Figure 3:
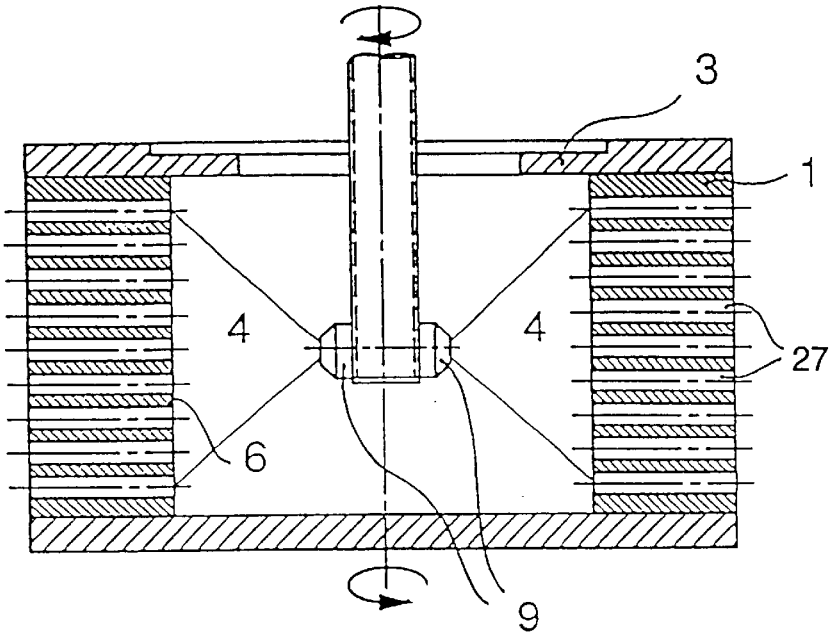
FIG. 3 illustrates a rotating cylinder with nozzles.

FIG. 3 shows a rotating cylinder with apertures 27 in the cylinder wall 1 and two rotating flat jet nozzles 9, which evenly distribute the liquid 4 on the interior cylinder surface 6, so that the throughput of liquid in each aperture 27 is the same.

Figure 4:
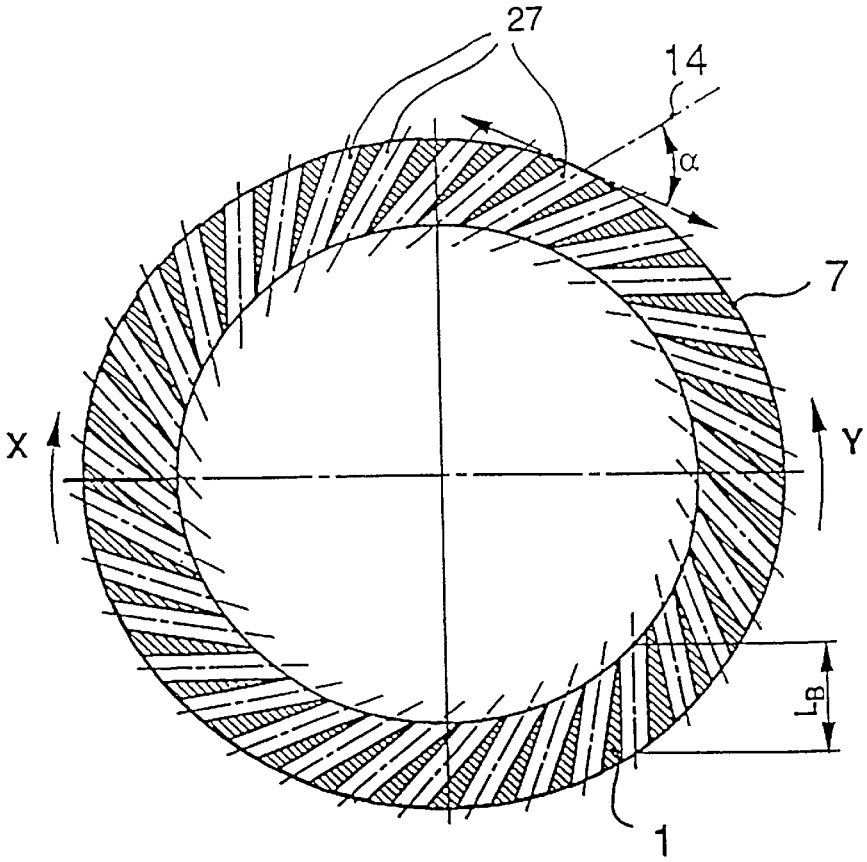
FIG. 4 is a cross-sectional view of a cylinder in the rotational plane.

FIG. 4 is a cross-sectional view of a cylinder in a rotational plane in which the extensions 14 of the axes of the apertures 27 outside of the exterior cylinder surface 7 form an angle $\alpha$, different from $\alpha=90°$, to the direction of the vector of the peripheral speed. The direction of rotation according to arrow x, corresponding to $\alpha<90°$, is preferably used for low-viscous liquids or for reducing the Reynolds Number $Re_\delta$, whereas the rotational direction according to arrow y, or $\alpha>90°$, is preferably used for high-viscous liquids and suspensions.

Figure 5:
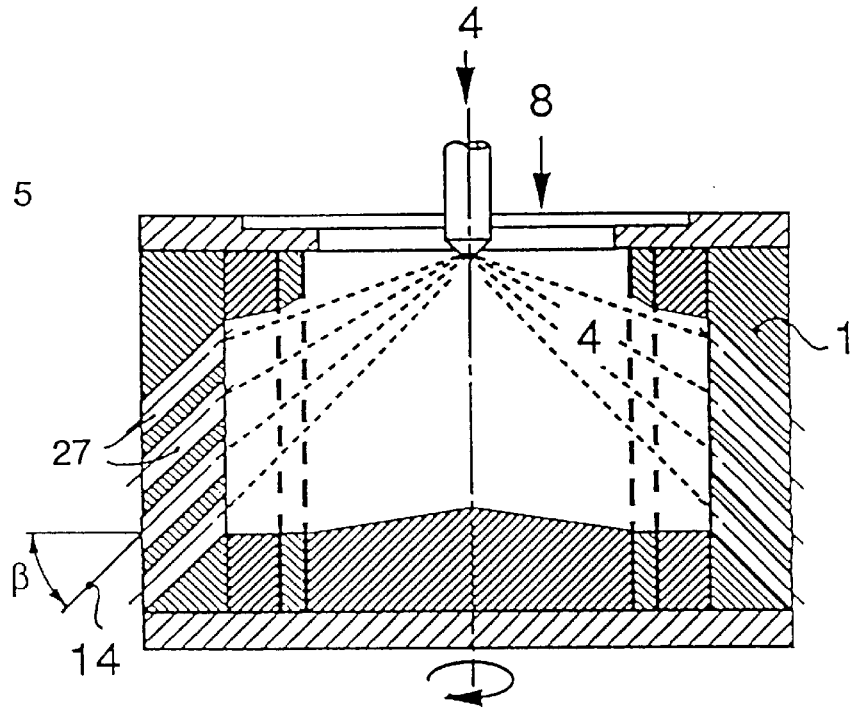
FIG. 5 illustrates a cylinder in which the axes of the apertures form an angle toward the rotational plane.

FIG. 5 shows a cylinder in which the axes 14 of the apertures 27 in the cylinder wall 1 form an angle $\beta$ towards the rotational plane. In addition to the liquid 4, gas 8 flows into the cylinder. The gas 8 leaving the cylinder through the apertures 27 deflects the droplets of the liquid 4 in the axial direction of the cylinder. Also, here, the Reynolds Number is reduced in comparison with radially running apertures.

Figure 6:
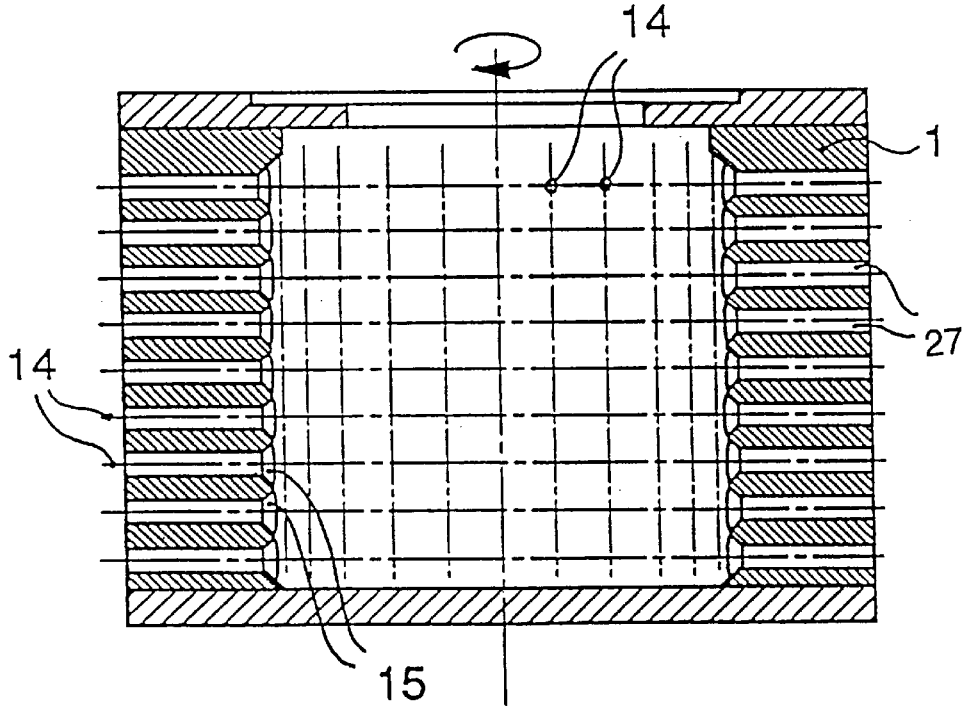
FIG. 6 is an axial cross-sectional view through a cylinder.

FIG. 6 is an axial sectional view through a cylinder which is particularly suited for suspensions. The apertures 27 are provided with counterbores 15 in the interior of the cylinder. On account of the complex geometry of the surface only the intersection points of the apertures axes 14 with the interior cylinder wall are indicated. Here a rectangular distribution is shown.

Figure 7:
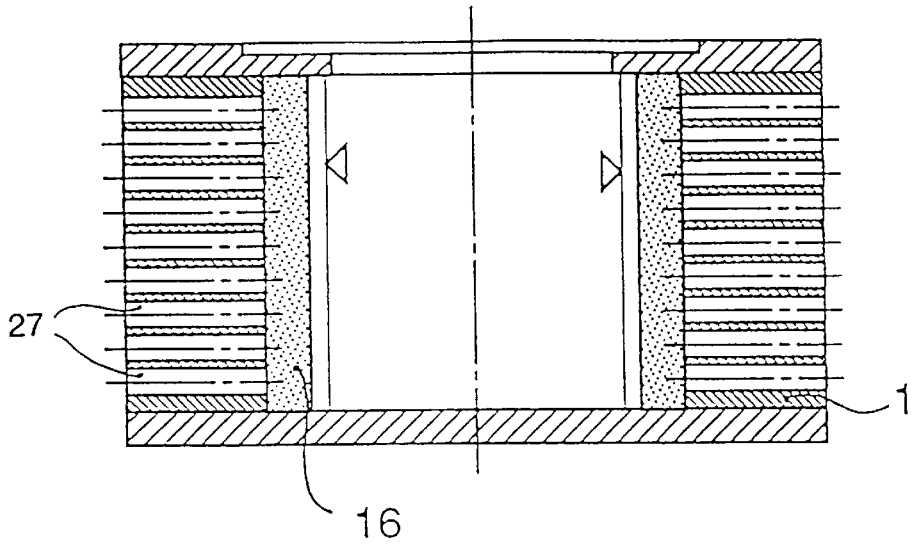
FIG. 7 is an axial cross-sectional view of a cylinder for use with a liquid free of solids.

FIG. 7 is an axial sectional view of a cylinder preferably used with a liquid free of solids. In the cylinder a porous cylindrical body 16 is present, the body being mounted concentrically to the cylinder. The cylindrical body 16 restricts and equalizes the throughput of liquid at each aperture 27.

Figure 8:
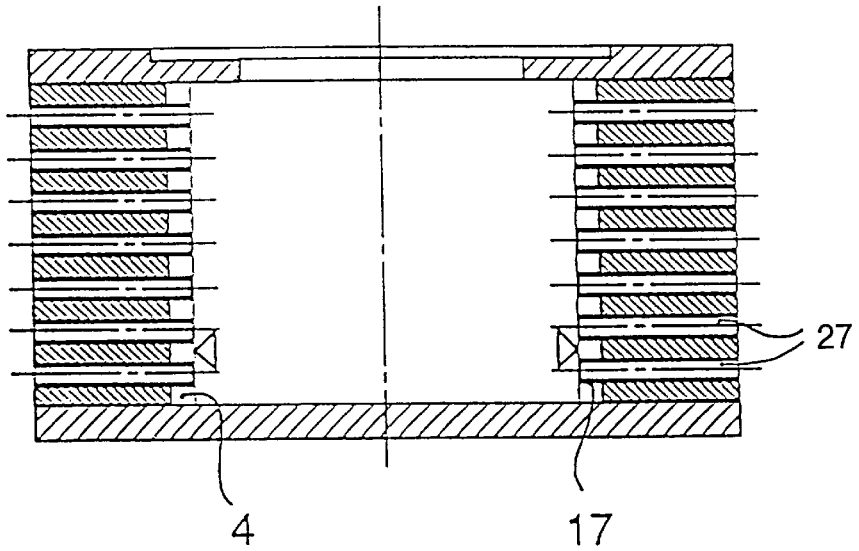
FIG. 8 illustrates a first preferred embodiment of the cylinder.

FIG. 8 shows a preferred embodiment of the cylinder. In this embodiment, which is particularly suited for pure liquids and melts, the edges of the apertures protrude inwardly. Thereby a cylindrical liquid layer is produced, which leads to an identical overflow of the surplus liquid 4 to each aperture 27. In this case, small tubes 17 are inserted in the apertures, the tubes all protruding with the same distance inwardly.

Figure 9:
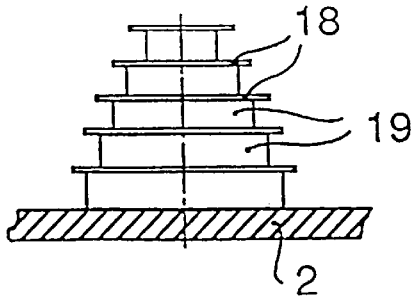
FIG. 9 illustrates a rotationally symmetrical distribution body.

FIG. 9 shows a rotationally symmetrical distribution body 11, the diameter of which increases towards the bottom and which includes circular plates 18 and spacers 19.

Figure 10:
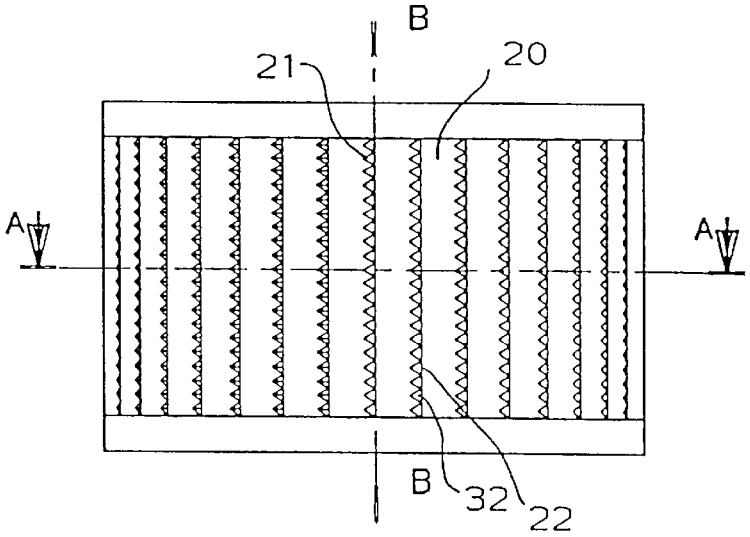
FIG. 10 illustrates a lateral view of a cylinder having triangular apertures.

FIG. 10 shows a lateral view of a cylinder with triangular apertures 32. The cylinder wall includes portions 20 with V-shaped grooves 21. The triangular apertures 32 are delimited partly by the grooves 21 of the portion 20, and partly by the backside 22 of the adjacent portion. For triangular apertures 32, the volumetric flow rate $\dot{V}_A$ should be such that $$V_A < 34{,}000 \cdot \frac{1}{\sin e\theta} \cdot \left(\frac{\eta}{\rho}\right)^{5/3} \cdot \frac{1}{a^{1/3}}.$$

Wherein $\theta$ is the angle formed between two flow surfaces which make up the triangular aperture.

Figure 11:
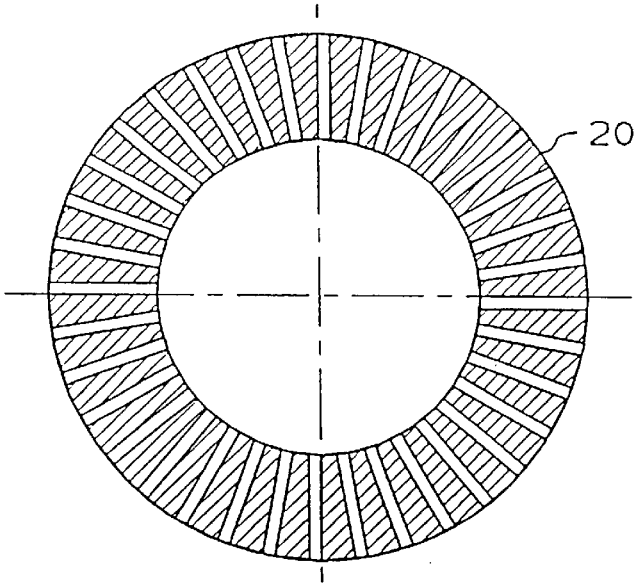
FIG. 11 is a cross-sectional view in the plane A—A of the embodiment of FIG. 10.

FIG. 11 shows a cross-sectional view in the plane A—A through the embodiment of the cylinder shown in FIG. 10.

Figure 12:
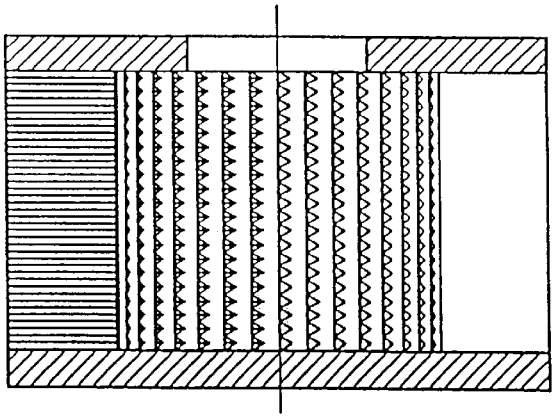
FIG. 12 is an axial cross-sectional view along a plane of B—B in FIG. 10.

FIG. 12 shows an axial sectional view in the plane B—B through the embodiment of the cylinder shown in FIG. 10.

Figure 13:
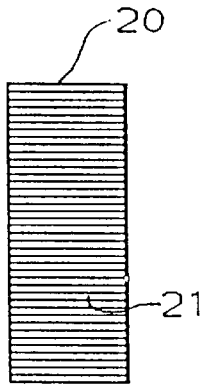
FIGS. 13–15 illustrate portions forming the cylinder wall.

FIG. 13 shows one of the portions 20, which forms part of the cylinder wall, seen towards the surface, which is provided with the V-shaped grooves 21.

Figure 14:
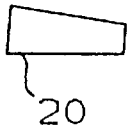

FIG. 14 shows the same portion seen from above.

Figure 15:
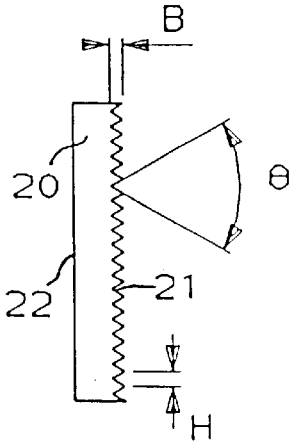

FIG. 15 shows the same portion 20, however, seen laterally. The angle indicated $\theta$ is the angle between the two flow surfaces of a groove. The width of an aperture, which is formed by a groove 21 and the adjacent plane backside of another portion 20 as shown in FIG. 10, is indicated by B and the height of this aperture by H.

Figure 16:
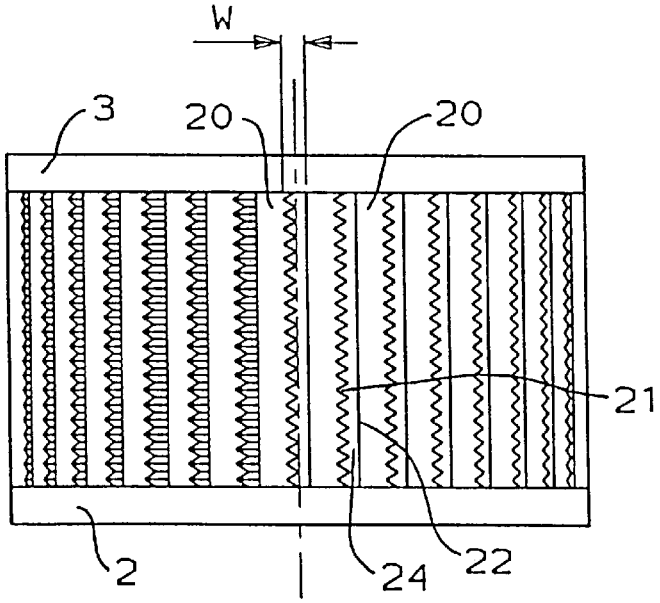
FIG. 16 is a side view of a cylinder having apertures with several V-shaped grooves.

FIG. 16 is a cylinder with larger apertures 24 having several V-shaped grooves 21. The cylinder wall consists of portions 20 with V-shaped grooves 21. The apertures 24 are delimited by the groove side of a portion 20, by the backside 22 of an adjacent portion 20, by the bottom of the cylinder 2 and by the cover of the cylinder 3. Several V-shaped grooves 21 arc present in each aperture 24. The V-shaped grooves 21 have a height H, and the apertures 24 have a width W. In this embodiment, in order to produce droplets bigger than or equal to 100 $\mu$m, for example, the width W of each aperture 24 should be such that $10<W\cdot(\rho a/\sigma)^{0.5}$, and the height H of each aperture 21 should be such that $H\cdot(\rho a/\sigma)^{0.5}<50$. Alternatively in this embodiment, to produce a droplet size of less than 100 $\mu$m, the width W of each aperture 24 should be such that $10<W\cdot(\rho a/\sigma)^{0.5}$, and the height H of each aperture 21 should be such that $H\cdot(\rho a/\sigma)^{0.5}<200$.

Figure 17:
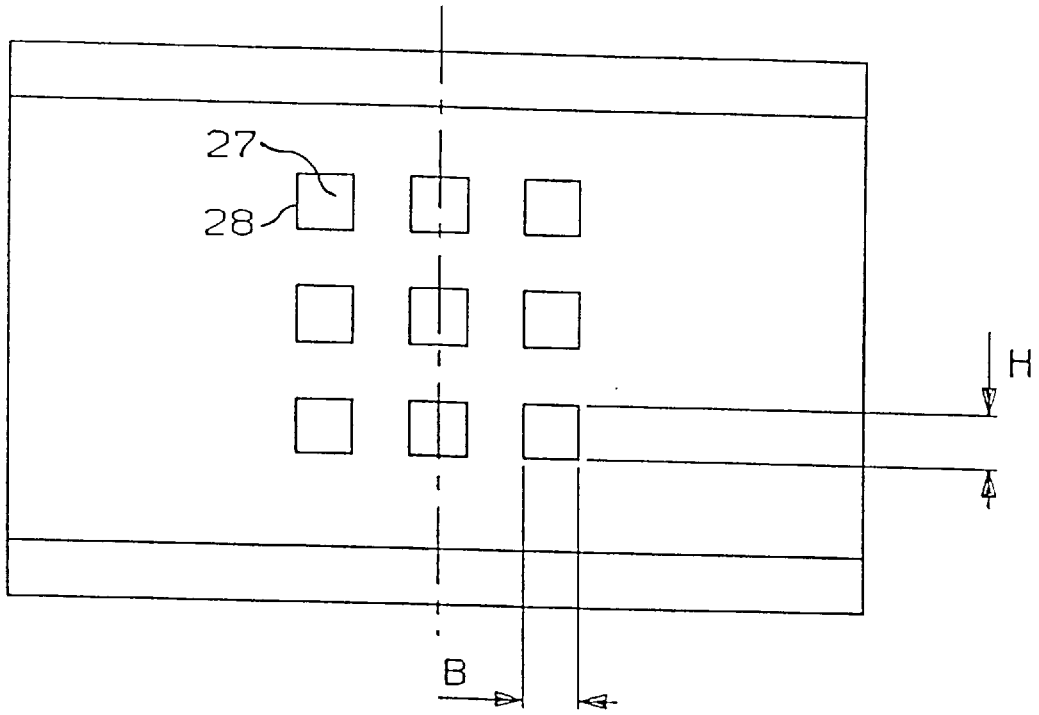
FIG. 17 is a lateral view of an embodiment in which the apertures of the cylinder wall are rectangular.

FIG. 17 is a lateral view of an embodiment, in which the apertures in the cylinder wall are rectangular apertures 27. One wall 28 serves as a flow surface. The apertures 27 have a width B, and a height H. For rectangular apertures 27, the volumetric flow rate $\dot{V}_A$ should be such that $$V_A < 400 \cdot \frac{\eta \cdot H}{\rho}.$$

In order to produce droplets bigger than or equal to 100 $\mu$m, with triangular or rectangular apertures (32,27) for example, the width B of each aperture (32,27) should be such that $10<B\cdot(\rho a/\sigma)^{0.5}<50$, and the height H of each aperture (32,27) should be such that $10<H\cdot(\rho a/\sigma)^{0.5}<50$.

In order to produce droplets smaller than 100 $\mu$m, with triangular or rectangular apertures (32,27) for example, the width B of each aperture (32,27) should be such that $10<B\cdot(\rho a/\sigma)^{0.5}<200$, and the height H of each aperture (32,27) should be such that $10<H\cdot(\rho a/\sigma)^{0.5}<200$.

It is contemplated that numerous modifications may be made to the process and device, for atomizing liquid, according to the present invention without departing from the spirit and scope of the invention as defined in the following claims.

We claim:

1. A process for atomizing a liquid (4), comprising the steps of:

introducing said liquid into a hollow, rotatable, cylinder having a cylinder wall (1) with an inner surface (6) and an outer surface (7) and having a plurality of apertures (21, 27, 32) formed between said inner and outer surfaces, and rotating said cylinder at a predetermined rotational speed, wherein the liquid (4) is evenly distributed on said inner cylinder surface (6) and over said apertures (21, 27, 32) to provide, per aperture (21, 27, 32), a volumetric flow rate $\dot{V}_A$ within the range $1.0<\dot{V}^A\ (a^3\cdot\rho^5/\sigma^5)^{0.25}<16$, where a represents the centrifugal acceleration of the cylinder at said outer surface (7), $\rho$ is the density of the liquid, $\sigma$ is the surface tension of the liquid and $\eta$ is the dynamic viscosity of the liquid (4), said centrifugal acceleration a being determined by $a=2\ D\ \pi^2 n^2$, where D is the diameter of said outer surface (7) and n is said predetermined rotational speed, whereby a laminar disintegration of jets of said liquid leaving said plurality of apertures is produced.

2. A process as claimed in claim 1, wherein said apertures are mainly triangular to provide two flow surfaces forming an angle $\theta$ with each other, and said volumetric flow rate $\dot{V}_A$ is further determined by $$V_A < 34{,}000 \cdot \frac{1}{\sin e\theta} \cdot \left(\frac{\eta}{\rho}\right)^{5/3} \cdot \frac{1}{a^{1/3}}.$$

3. A process as claimed in claim 1, wherein in addition to said liquid (4), also a gas (8) is introduced into said cylinder.

4. A process as claimed in claim 1, wherein said apertures are rectangular, and said volumetric flow rate $\dot{V}_A$ is further determined by $$V_A < 400 \cdot \frac{\eta \cdot H}{\rho},$$

where H is the height of the rectangular aperture.

5. A process as claimed in claim 1, wherein a laminar flow is produced in each of said apertures, for which the Reynolds number $Re_\delta$ does not exceed 400.

6. A process as claimed in claim 1, wherein said liquid is introduced into said cylinder by nozzle means.

7. A process as claimed in claim 6, wherein said nozzles means comprises a pneumatic atomizing nozzle (10).

8. A process as claimed in claim 6, wherein said nozzle means comprises a one-fluid nozzle.

9. A device, for atomizing a liquid (4), comprising:

a hollow rotatable cylinder having a cylinder wall (1) with an inner surface (6) and an outer surface (7), a bottom side closed by a bottom (2) and an upper side limited by a cover (3) with a central opening, a plurality of apertures (27, 32) each having a height H, a width B and a length L being formed in the cylinder wall (1) between said inner and outer surfaces (6, 7), the relation L:B between said length L and said width B being at least 3, said width B of each aperture lying in the range $10<B\cdot(\rho a/\sigma)^{0.5}<50$ and said height H of each aperture lying in the range $10<H\cdot(\rho a/\sigma)^{0.5}<50$ for the production of droplets with an average droplet size which is bigger than or equal to 100 $\mu$m upon rotation of the cylinder at a predetermined rotational speed;

where a represents the centrifugal acceleration of the cylinder at said outer surface (7), $\rho$ is the density of the liquid, and ($\sigma$ is the surface tension of the liquid (4), said centrifugal acceleration being determined by $a=2\ D\ \pi^2 n^2$, where D is the diameter of said outer surface (7) and n is said predetermined rotational speed, whereby a laminar disintegration of jets of said liquid leaving said plurality of apertures is produced.

10. A device as claimed in claim 9, wherein the number of said apertures is at least 200.

11. A device as claimed in claim 9, wherein said apertures (27) are rectangular.

12. A device as claimed in claim 9, wherein said apertures (27,32) are provided in the interior of said cylinder with recesses.

13. A device as claimed in claim 9, wherein said apertures (27,32) have such directions that the extension of their axes over said outer cylinder surface (7) forms an angle $\alpha$ with the vector of the peripheral speed which lies in the range $10°<\alpha<170°$.

14. A device as claimed in claim 9, wherein said apertures (27,32) have such directions that the extension of their axes over said outer cylinder surface (7) are inclined by an angle $\beta$ in a range $0°<\beta<80°$ with respect to the plane of rotation.

15. A device according to claim 14, further comprising baffles (13) in the form of helically wound wire nettings, wherein a mesh width of said wire nettings is bigger than the apertures (27) disposed in the interior of the cylinder.

16. A device as claimed in claim 9, wherein a second cylindrical porous body (16) having a uniform wall thickness is mounted concentrically in said cylinder.

17. Use of the device claimed in claim 9 for spray drying of products.

18. Use of the device claimed in claim 9 to manufacture powders from melts.

19. A device as claimed in claim 9, wherein said apertures (32) are triangular.

20. A device, for atomizing a liquid (4), comprising:

a hollow rotatable cylinder having a cylinder wall (1) with an inner surface (6) and an outer surface (7), a bottom side closed by a bottom (2) and an upper side limited by a cover (3) with a central opening, a plurality of apertures (21) formed as grooves in a wall of each of a plurality of bigger apertures (24), each of said grooves (21) having a height H and each of said bigger apertures (24) having a width W and a length L being formed in the cylinder wall (1) between said inner and outer surfaces (6,7), the relation L:W between said length L and said width W being at least 3, said width W of each bigger aperture (24) lying in the range $10<W\cdot(\rho a/\sigma)^{0.5}$ and said height H of each groove (21) lying in the range $H\cdot(\rho a/\sigma)^{0.5}<50$ for the production of droplets with an average droplet size which is bigger than or equal to 100 $\mu$m upon rotation of the cylinder at a predetermined rotational speed;

where a represents the centrifugal acceleration of the cylinder at said outer surface (7), $\rho$ is the density of the liquid, and $\sigma$ is the surface tension of the liquid (4), said centrifugal acceleration being determined by $a=2\ D\ \pi^2 n^2$, where D is the diameter of said outer surface (7) and n is said predetermined rotational speed, whereby a laminar disintegration of jets of said liquid leaving said plurality of apertures is produced.

21. A device as claimed in claim 20, wherein said grooves (21) are V-shaped.

22. A device as claimed in claim 20, wherein the number of said grooves (21) is at least 200.

23. A device as claimed in claim 20, wherein said grooves (21) are rectangular.

24. A device as claimed in claim 20, wherein said apertures (21, 24) are provided in the interior of said cylinder with recesses.

25. A device as claimed in claim 20, wherein said apertures (21, 24) have such directions that the extension of their axes over said outer cylinder surface (7) forms an angle $\alpha$ with the vector of the peripheral speed which lies in the range $10°<\alpha<170°$.

26. A device as claimed in claim 20, wherein a second cylindrical porous body (16) having a uniform wall thickness is mounted concentrically in said cylinder.

27. Use of the device claimed in claim 20 for spray drying of products.

28. Use of the device claimed in claim 20 for the manufacture of powders from melts.

29. A device for atomizing a liquid (4) comprising a hollow rotatable cylinder having a cylinder wall (1) with an inner surface (6) and an outer surface (7), a bottom side closed by a bottom (2) and an upper side limited by a cover (3) with a central opening, a plurality of apertures (27,32) each having a height H, a width B, and a length L, being formed in the cylinder wall (1) between said inner and outer surfaces (6, 7), the relation L:B between said length L and said width B being at least 3, said width B of each aperture lying in the range $10<B\cdot(\rho a/\sigma)^{0.5}<200$ and said height H of each aperture lying in the range $10<H\cdot(\rho a/\sigma)^{0.5}<200$ for the production of droplets with an average droplet size which is smaller than 100 $\mu$m upon rotation of the cylinder at a predetermined rotational speed, where a represents the centrifugal acceleration of the cylinder at said outer surface (7), $\rho$ is the density of the liquid, and $\sigma$ is the surface tension of the liquid (4), said centrifugal acceleration being determined by $a=2\ D\ \pi^2 n^2$, where D is the diameter of said outer surface (7) and n is said predetermined rotational speed, whereby a laminar disintegration of jets of said liquid leaving said plurality of apertures is produced.

30. A device as claimed in claim 29, wherein the number of said apertures is at least 200.

31. A device as claimed in claim 29, wherein said apertures (27) are rectangular.

32. A device as claimed in claim 29, wherein said apertures (27,32) are provided in the interior of said cylinder with recesses.

33. A device as claimed in claim 29, wherein said apertures (27,32) have such directions that the extension of their axes over said outer cylinder surface (7) forms an angle $\alpha$ with the vector of the peripheral speed which lies in the range $10°<\alpha<170°$.

34. A device as claimed in claim 29, wherein said apertures (27,32) have such directions that the extension of their axes over said outer cylinder surface (7) are inclined by an angle $\beta$ in the range $0°<\beta<80°$ with respect to the plane of rotation.

35. A device as claimed in claim 29, wherein a second cylindrical porous body (16) having a uniform wall thickness is mounted concentrically in said cylinder.

36. Use of the device claimed in claim 29 for spray drying of products.

37. Use of the device claimed in claim 29 for the manufacture of powders from melts.

38. A device as claimed in claim 29, wherein said apertures (32) are triangular.

39. A device, for atomizing a liquid (4), comprising:

a hollow rotatable cylinder having a cylinder wall (1) with an inner surface (6) and an outer surface (7), a bottom side closed by a bottom (2) and an upper side limited by a cover (3) with a central opening, a plurality of apertures (21) formed as grooves in a wall of each of a plurality of bigger apertures (24), each of said grooves (21) having a height H and each of said bigger apertures (24) having a width W and a length L being formed in the cylinder wall (1) between said inner and outer surfaces (6,7), the relation L:W between said length L and said width W being at least 3, said width W of each bigger aperture (24) lying in the range $10<W\cdot(\rho a/\sigma)^{0.5}$ and said height H of each groove (21) lying in the range $H\cdot(\rho a/\sigma)^{0.5}<200$ for the production of droplets with an average droplet size which is smaller than 100 $\mu$m upon rotation of the cylinder at a predetermined rotational speed, where a represents the centrifugal acceleration of the cylinder at said outer surface (7), $\rho$ is the density of the liquid, and $\sigma$ is the surface tension of the liquid (4), said centrifugal acceleration being determined by $a=2\ D\ \pi^2 n^2$, where D is the diameter of said outer surface (7) and n is said predetermined rotational speed, whereby a laminar disintegration of jets of said liquid leaving said plurality of apertures is produced.

40. A device as claimed in claim 39, wherein the number of said grooves is at least 200.

41. A device as claimed in claim 39, wherein said grooves (21) are rectangular.

42. A device as claimed in claim 39, wherein said apertures (21,24) are provided in the interior of said cylinder with recesses.

43. A device as claimed in claim 39, wherein said apertures (21,24) have such directions that the extension of their axes over said outer cylinder surface (7) forms an angle $\alpha$ with the vector of the peripheral speed which lies in the range $10°<\alpha<170°$.

44. A device as claimed in claim 39, wherein a second cylindrical porous body (16) having a uniform wall thickness is mounted concentrically in said cylinder.

45. Use of the device claimed in claim 39 for spray drying of products.

46. Use of the device claimed in claim 39 for the manufacture of powders from melts.

47. A device as claimed in claim 39, wherein said grooves (21) are V-shaped.

* * * * *